US011168695B2

(12) United States Patent
Christ et al.

(10) Patent No.: US 11,168,695 B2
(45) Date of Patent: Nov. 9, 2021

(54) VORTEX PUMP

(71) Applicant: KSB SE & Co. KGAA, Frankenthal (DE)

(72) Inventors: Alexander Christ, Frankenthal (DE); Christoph Jaeger, Frankenthal (DE); Michael Nutz, Frankenthal (DE); Rolf Witzel, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 39 days.

(21) Appl. No.: 16/472,128

(22) PCT Filed: Nov. 10, 2017

(86) PCT No.: PCT/EP2017/078857
§ 371 (c)(1),
(2) Date: Jun. 20, 2019

(87) PCT Pub. No.: WO2018/114133
PCT Pub. Date: Jun. 28, 2018

(65) Prior Publication Data

US 2019/0316590 A1 Oct. 17, 2019

(30) Foreign Application Priority Data

Dec. 21, 2016 (DE) ..... 10 2016 225 908.3

(51) Int. Cl.
*F04D 15/00* (2006.01)
*F04D 7/04* (2006.01)
(Continued)

(52) U.S. Cl.
CPC ..... *F04D 15/0033* (2013.01); *F04D 7/045* (2013.01); *F04D 29/4293* (2013.01);
(Continued)

(58) Field of Classification Search
CPC .... F04D 7/045; F04D 15/0033; F04D 29/042; F04D 29/052; F04D 29/2244;
(Continued)

(56) References Cited

U.S. PATENT DOCUMENTS 4,405,290 A * 9/1983 Rannenberg ..... F04D 29/462 415/27
2015/0292519 A1 10/2015 Stark et al.
2019/0316590 A1* 10/2019 Christ ..... F04D 7/045

FOREIGN PATENT DOCUMENTS

DE 1 005 844 A 4/1957
DE 41 42 120 A1 6/1993
(Continued)

OTHER PUBLICATIONS

Machine translation of DE 102013005517 (Oct. 24, 2013) (Year: 2013).*
(Continued)

*Primary Examiner* — Kenneth Bomberg
*Assistant Examiner* — Christopher R Legendre
(74) *Attorney, Agent, or Firm* — Crowell & Moring LLP

(57) ABSTRACT

A centrifugal pump for delivering a medium comprising solid admixtures includes a blade-free space arranged in front of an impeller. The centrifugal pump has a suction-side arrangement that permits variable sizing of the blade-free space. The suction-side arrangement permits the efficiency of the centrifugal pump to be increased while avoiding blockages.

7 Claims, 1 Drawing Sheet

(51) Int. Cl.
*F04D 29/42* (2006.01)
*F04D 29/46* (2006.01)

(52) U.S. Cl.
CPC ..... *F04D 29/464* (2013.01); *F05D 2270/64* (2013.01); *F05D 2270/65* (2013.01)

(58) Field of Classification Search
CPC .... F04D 29/4293; F04D 29/46; F04D 29/462; F04D 29/464
See application file for complete search history.

(56) References Cited

FOREIGN PATENT DOCUMENTS

| | | | |
|---|---|---|---|
| DE | 198 23 603 | A1 | 12/1999 |
| DE | 103 01 629 | A1 | 7/2004 |
| DE | 10 2009 011 444 | A1 | 9/2010 |
| DE | 10 2013 005 517 | A1 | 10/2013 |
| DE | 10 2012 023 734 | A1 | 6/2014 |
| EP | 1 616 100 | B1 | 2/2010 |
| GB | 751908 | A | 7/1956 |
| JP | 56-121895 | A | 9/1901 |
| JP | 55-142998 | A | 11/1980 |
| WO | WO 2015/022601 | A1 | 2/2015 |

OTHER PUBLICATIONS

Machine translation of DE 4142120 (Jun. 24, 1993) (Year: 1993).*
Machine translation of JPS55142998 (Nov. 7, 1980) (Year: 1980).*
International Search Report (PCT/ISA/210) issued in PCT Application No. PCT/EP2017/078857 dated Feb. 19, 2018 with English translation (five (5) pages).
German-language Written Opinion (PCT/ISA/237) issued in PCT Application No. PCT/EP2017/078857 dated Feb. 19, 2018 (five (5) pages).
German-language Search report issued in counterpart German Application No. 10 2016 225 908.3 dated Sep. 14, 2017 with partial English translation (eight (8) pages).
International Preliminary Report on Patentability (PCT/IB/338 & PCT/IB/373) issued in PCT Application No. PCT/EP2017/078857 dated Jul. 4, 2019, including English translation of document C2 (Japanese-language Written Opinion (PCT/ISA/237) previously filed on Jun. 20, 2019) (eight (8) pages).

* cited by examiner

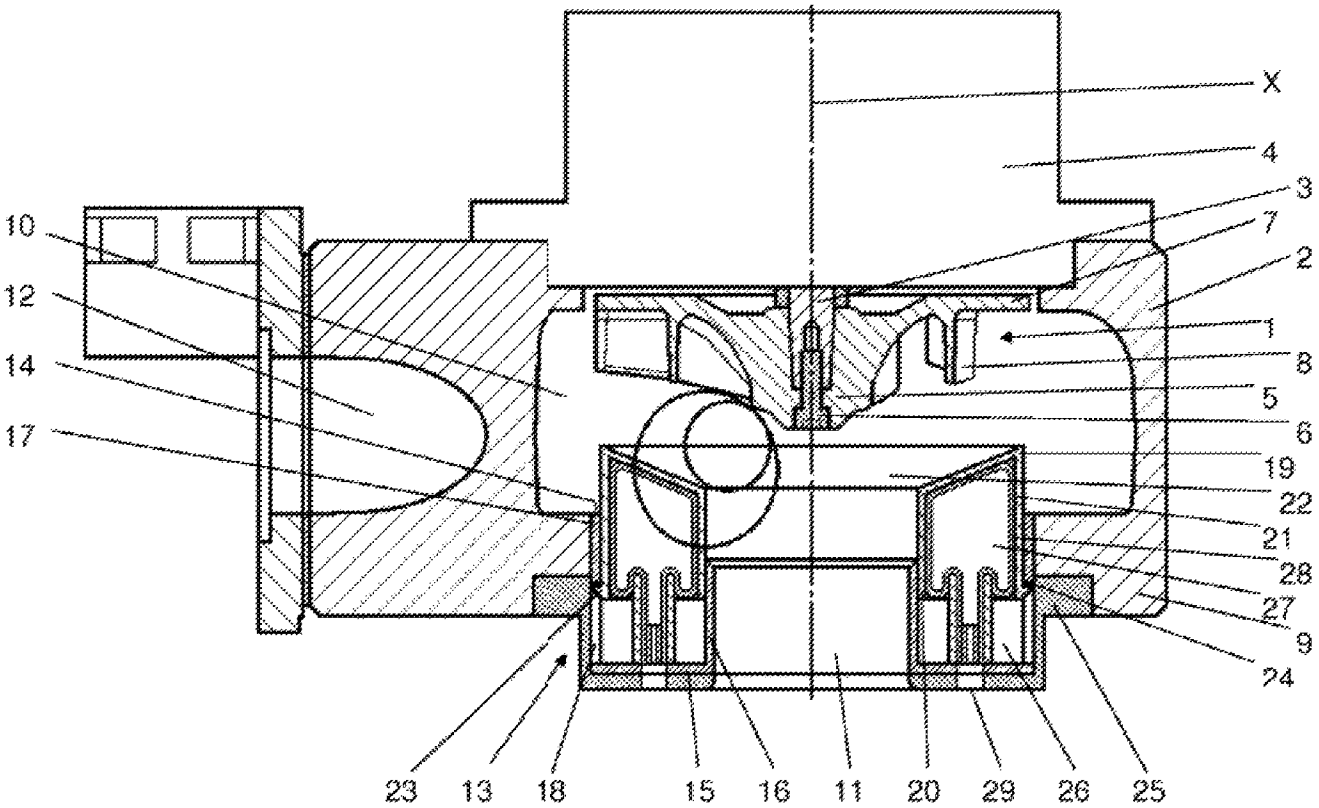
X
4
3
7
2
1
8
5
6
19
22
21
28
27
9
24
25
26
29
20
11
16
15
18
13
23
10
12
14
17

VORTEX PUMP

CROSS REFERENCE TO RELATED APPLICATIONS

This application is a national phase entry of PCT International Application No. PCT/EP2017/078857, filed Nov. 10, 2017, which claims priority under 35 U.S.C. § 119 from German Patent Application No. 10 2016 225 908.3, filed Dec. 21, 2016, the entire disclosures of which are herein expressly incorporated by reference.

BACKGROUND AND SUMMARY OF THE INVENTION

The invention relates to a centrifugal pump for conveying a medium comprising solid additives, wherein a blade-free space is arranged upstream of an impeller.

In such pumps, vortex impellers are used as impellers. These have a large spacing between the impeller blades and the inlet-side casing wall. In this way, a free space is formed which permits the conveyance of media with solid additives, even if the additives have large dimensions. A characteristic variable in vortex pumps is the "ball passage". This is a minimum spacing which is present in relation to the casing wall in the inflow region of the pump and which corresponds to the diameter of an imaginary ball. The larger the ball passage, the larger the solid particles that can be conveyed by means of the pump without blockage.

DE 10 2009 011 444 A1 describes a centrifugal pump for conveying a medium comprising solid additives. A vortex impeller is arranged in the casing of the pump. A blade-free space is formed between the vortex impeller and the inlet-side casing wall. Blades are formed integrally on the rear shroud of the vortex impeller. The blades are equipped with cutting edges.

EP 1 616 100 B1 describes a vortex pump, the impeller of which is composed of a rear shroud equipped with open blades. Here, at least one of the blades has a smaller height than the other blades. That side of the rear shroud which faces toward a suction-side casing wall, between hub body and impeller outlet, has a concave profile. Between the leading edge of the blade with the relatively small height and the casing wall of the vortex pump, there is a free passage for a ball-shaped object. The casing wall runs conically, wherein the spacing of the casing wall to the leading edges of the relatively tall blades of the impeller decreases with the diameter, and wherein the passage with the minimum extent follows in approximately unchanging fashion over the entire profile of a leading edge of at least one blade of relatively small height which is inclined toward the impeller outlet.

DE 103 01 629 B4 relates to a vortex pump with a casing in which, on the one hand, there is arranged an impeller which is not covered at its outer diameter and in which, on the other hand, an open space is formed between the impeller and the suction-side casing wall. The casing space situated radially with respect to the impeller is asymmetrical as seen in meridional section. The spacing of the suction-side casing wall to the impeller decreases continuously with the diameter. Between the impeller and the suction-side casing wall, there is, over the entire circumference, a spacing which is such that a solid object, which corresponds in terms of its largest extent to the diameter of a predefined ball, contained in the liquid for conveying can pass through the vortex pump.

The size of the blade-free space of a vortex pump has a significant influence on the efficiency of a pump of said type.

The smaller the space, the greater the efficiency generally is. If the blade-free space is decreased in size to a very great extent for efficiency reasons, blockages can very easily occur in the pump.

In the prior art, for example from WO 2015/022601 A1, solutions are known in which the entire impeller is displaced in the casing in order to vary the blade-free space upstream of the impeller. Such solutions are highly complex and expensive.

It is an object of the invention to specify a vortex pump which can reliably convey media with solid additives' without blockages occurring, and which at the same time exhibits the highest possible efficiency. It is the intention for the pump to be distinguished by an inexpensive method of production and by a long service life. Furthermore, it is the intention for the pump to be usable for different media with different additives, wherein it is the intention in each case to ensure the highest possible efficiency and, at the same time, prevent blockages.

The centrifugal pump according to the invention has a suction-side arrangement. With this arrangement, the blade-free space upstream of the impeller can be increased or decreased in size in targeted fashion. Using a variable adaptation of the space size by means of the arrangement, the pump can be set in targeted fashion for the medium that is to be conveyed in each case. A variable front impeller side space is thus created. This is realized in a simple and reliable manner without the need for the impeller to be varied in terms of its position.

If only small additives are present, then the blade-free space is reduced in size and greater efficiency is ensured, even without blockages occurring. In the case of media with which there is an increased risk of blockage, the space is enlarged. Here, a lower efficiency is accepted. The device according to the invention thus permits an adapted in accordance with the medium for conveying. Furthermore, in the event of an acutely occurring blockage, the blade-free space can be enlarged.

The variable suction-side arrangement preferably ensures a continuously variable adjustment for the increase or decrease in size of the space upstream of the vortex impeller. The ball passage can be varied in continuously variable fashion, with an optimum efficiency being ensured in each case and, at the same time, a blockage being prevented.

It has proven here to be expedient if the arrangement is arranged around an axially directed inlet. The medium flows to the vortex impeller through the axially directed inlet. The arrangement may be positioned in ring-shaped fashion around the suction mouth on the inside casing wall.

Alternatively, the arrangement itself may be of ring-shaped form. In one variant of the invention, the arrangement forms a suction mouth. In this variant, the arrangement itself is part of the suction-side casing or forms the suction-side casing.

In a particularly advantageous embodiment of the invention, the arrangement comprises an elastic wall for the adaptation of the space. The wall may be a diaphragm. The space between the vortex impeller and casing wall is adapted in targeted fashion by expansion of the wall or by retraction of the expansion. An adjustable insert is used, wherein a movement body increases and/or decreases, in targeted fashion, the size of the space through which the medium for conveying flows.

In one variant of the invention, the arrangement comprises a hollow body. The hollow body has a port through which a filling fluid can be fed and discharged. The hollow body may for example be a hose-like structure. By means of the feed of a medium, such as for example water, compressed air, pressurized oil or the like, the hollow body can be expanded, and in this way the size of the space, through which flow passes, upstream of the impeller can be influenced.

The elastic material may undergo a defined spatial change by means of different media, for example also ferromagnetizable liquids. If a state is attained in which the functionality is impaired, the change in shape is retracted again and the original shape is re-assumed. The change in shape may also be affected by means of memory metal.

In one variant of the invention, the arrangement comprises an axially movable element. This may for example be a compact pneumatic cylinder for a spatial change or change in shape. Here, elements change their axial spacing with respect to the impeller and thus increase or decrease the size of the blade-free space, through which the medium flows, upstream of the vortex impeller.

The arrangement may be arranged on the suction-side casing part. Alternatively, the suction-side casing part itself may also be formed by the arrangement. In one variant of the invention, suction-side casing parts are arranged so as to be axially displaceable, and thus adapt the free space, through which flow passes, upstream of the impeller wheel in terms of its size.

It has proven to be particularly expedient if the centrifugal pump is equipped with a detector which is connected to the arrangement. Blockages can be detected by the detector. The arrangement can then react to these in targeted fashion and increase the size of the space such that said blockage is released, or such that no blockages occur in the first place. For the detection of a blockage, various measured variables may be taken into consideration, for example a pressure drop and/or a power consumption of the pump.

An autoadaptive system is thus created which prevents blockages and, here, simultaneously ensures the highest possible efficiency of the pump.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 1 shows a section through a vortex pump in accordance with the present invention.

DETAILED DESCRIPTION OF THE DRAWINGS

FIG. 1 shows a vortex pump for conveying a medium comprising solid additives. The pump comprises an impeller 1, which in this embodiment is designed as a vortex impeller. The impeller 1 is at least partially enclosed by a casing 2. The impeller 1 is positioned on a shalt 3, which can be driven in rotation about an axis of rotation X by a drive 4. The fastening of the impeller 1 is realized by a hub body 5, into which a screw 6 engages.

Multiple blades 8 are arranged on a rear shroud 7 of the impeller 1. Between the impeller 1 and an inlet-side casing wall 9, there is formed a blade-free space 10, which is flowed through by the medium. The medium comprising solid additives flows to the impeller 1 through an axially directed inlet 11. The medium is conveyed by the impeller 1 and exits the centrifugal pump through an outlet 12. The casing 2 illustrated in FIG. 1 is a spiral casing.

The centrifugal pump has a variable suction-side arrangement 13. The arrangement 13 is, in this embodiment, integrated into an opening 14 of the inlet-side casing wall 9. The variable suction-side arrangement 13 is, in this embodiment, of ring-shaped form.

Said arrangement comprises a guide body 15 which extends into the opening 14 from the outside and which has an inner ring-shaped guide wall 16 and an outer ring-shaped guide wall 17. The inner guide wall 16 furthermore forms the axially directed inlet for the medium. In the guide wall 17, there is formed at least one guide groove 18 which extends, parallel to the axis of rotation X, from a region averted from the space 10 approximately as far as the center of the outer guide wall 17.

The variable arrangement 13 furthermore comprises an axially movable element which, in the embodiment shown, constitutes a movement body 19 which can be guided axially by the guide walls 16 and 17 and which is of ring-shaped design and which has an inner ring wall 20, which interacts with the guide wall 16, and an outer ring wall 21, which interacts with the guide wall 17. The ring wall 20 and ring wall 21 are connected to one another, close to the space 10, by a ring-shaped disk 22.

Since the inner ring wall 20 has a smaller height in an axial direction than the outer ring wall 2, the ring-shaped disk 22 has a conical design. The ring-shaped wall 21 has axially outwardly directed projection 23 which projects into the guide groove 18. By virtue of the fact that the guide groove 18 extends substantially as far as the center of the guide wall 17, a shoulder 24 is formed there, against which the projection 23 of the movement body 19 bears during normal operation. Thus, the axial movement of the movement body 19 into the space 10 is limited. In the embodiment illustrated, the guide body 15 is fixed by a closure element 25 in the opening 14 of the casing wall 9 of the casing body 2. The closure element 25 is fixed to the inlet-side casing wall 9 by fastening means which are not illustrated. In an alternative embodiment, the guide body 15 and movement body 19 may be formed as a single piece.

The guide walls 16 and 17 form, together with the ring-shaped walls 20 and 21, a ring-shaped space 26 in which an elastic wall 28, which forms a hollow body 27, is arranged. In this embodiment, the elastic wall 28 is designed as an expandable diaphragm. Through at least one port device 29, a filling fluid, for example in the form of hydraulic oil or compressed air, can be fed to the hollow body 27, which is displaced in an axial direction in the direction of the impeller 1, and in so doing expands the diaphragm 28, owing to the pressure of the filling fluid. In this way, the movement body 19 is moved in the direction of the blade-free space 10, whereby the latter is reduced in size. This arrangement of the movement body 19 corresponds to normal operation. A smaller ball passage therefore also results, which is illustrated in FIG. 1 as a schematic line with a relatively small ball diameter. In this position of the arrangement 13, the centrifugal pump exhibits high efficiency.

If a blockage is detected by a detector which is not illustrated in FIG. 1, then the arrangement 13 reacts and increases the size of the blade-free space 10 through which flow passes. For this purpose, the filling fluid is released out of the hollow body 27 and the diaphragm 28 contracts. The movement body 19 is moved in the axial direction out of the blade-free space 10. As a result, a larger ball passage is ensured, which is schematically illustrated in FIG. 1 as a circle with the relatively large diameter.

The arrangement 13 according to the invention permits a continuously variable variation of the front impeller side space 10, without the impeller 1 having to be displaced in terms of its position.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A centrifugal pump for conveying a medium comprising solid additives, comprising:

a pump casing having a casing space;

an impeller arranged in the casing space with a blade-free space upstream of the impeller between the impeller and an inlet of the pump casing; and a guide body having an inner wall defining the inlet, an outer wall attached to the pump casing, and a ring-shaped space radially between the inner wall and the outer wall a hollow body arranged in the ring-shaped space, the hollow body being configured to be displaced axially along the inner wall and the outer wall toward or away from the impeller to change a size of the blade-free space in response to receipt or withdrawal of a filling fluid in the hollow body.

2. The centrifugal pump as claimed in claim 1, wherein the hollow body is ring-shaped.

3. The centrifugal pump as claimed in claim 1, wherein the hollow body has an elastic wall configured to change the size of the blade-free space by expansion or contraction of the elastic wall.

4. The centrifugal pump as claimed in claim 3, wherein the hollow body has a port configured to receive and discharge the filling fluid.

5. The centrifugal pump as claimed in claim 1, wherein the inner wall and the outer wall are configured to guide axial movement of the hollow body during a change of the size of the blade-free space.

6. The centrifugal pump as claimed in claim 1, wherein the hollow body is arranged on a suction-side of the pump casing.

7. The centrifugal pump as claimed in claim 1, wherein the displaceable hollow body is configured to change the size of the blade-free space in response to detection of one or both of a pressure drop and a power consumption of the pump.

* * * * *